US008096796B2

(12) United States Patent
Ginies et al.

(10) Patent No.: US 8,096,796 B2
(45) Date of Patent: Jan. 17, 2012

(54) TEMPORARY SELF-LUBRICATING COATING FOR SCROLL COMPRESSOR

(75) Inventors: Pierre Ginies, Sathonay Village (FR); Gael Meldener, Lyons (FR); Olivier Paillon, Tramoyes (FR)

(73) Assignee: Danfoss Commercial Compressors, Trevoux (FR)

( * ) Notice: Subject to any disclaimer, the term of this patent is extended or adjusted under 35 U.S.C. 154(b) by 845 days.

(21) Appl. No.: 12/060,394

(22) Filed: Apr. 1, 2008

(65) Prior Publication Data

US 2009/0191079 A1 Jul. 30, 2009
US 2011/0311384 A9 Dec. 22, 2011

Related U.S. Application Data

(63) Continuation of application No. PCT/IB2008/001318, filed on Jan. 30, 2008.

(51) Int. Cl.
*F01C 21/04* (2006.01)
*F04C 29/02* (2006.01)

(52) U.S. Cl. ..... 418/178; 418/55.6; 184/6.16

(58) Field of Classification Search ..... 418/55.1–55.6, 418/178; 184/6.16
See application file for complete search history.

(56) References Cited

U.S. PATENT DOCUMENTS 4,082,484 A * 4/1978 McCullough ..... 418/55.2
4,624,887 A * 11/1986 Bickle et al. ..... 442/19
5,364,248 A * 11/1994 Nakashima et al. ..... 418/178
5,630,668 A * 5/1997 Ikezawa et al. ..... 384/527
6,106,936 A 8/2000 Adam
6,213,742 B1 * 4/2001 Goto et al. ..... 418/55.2
6,378,415 B1 4/2002 Sugiura
6,416,851 B1 * 7/2002 Kuroiwa et al. ..... 428/304.4
6,878,677 B1 * 4/2005 Sakanoue et al. ..... 508/433
7,144,235 B2 * 12/2006 Yoshimura et al. ..... 418/201.1
7,811,071 B2 * 10/2010 Fontaine et al. ..... 418/178
2007/0031275 A1 2/2007 Nogawa
2008/0025861 A1 * 1/2008 Okawa et al. ..... 418/178
2009/0110581 A1 * 4/2009 Fontaine et al. ..... 418/55.3

FOREIGN PATENT DOCUMENTS

EP 1860156 11/2007
JP 2007127093 5/2007
JP 2007224767 9/2007
WO WO 2006035680 A1 * 4/2006
WO WO 2006128702 A1 * 12/2006

OTHER PUBLICATIONS

International Search Report and written opinion mailed Mar. 11, 2009.

* cited by examiner

*Primary Examiner* — Mary A Davis
(74) *Attorney, Agent, or Firm* — Carlson, Gaskey & Olds, PC

(57) ABSTRACT

A sealed compressor is provided with a spray lubricant that will provide lubricant at various bearing surfaces during initial start-up of the compressor. The lubricant will wear away quickly after initial run-in, but liquid lubricant will be provided by that time.

20 Claims, 3 Drawing Sheets

TEMPORARY SELF-LUBRICATING COATING FOR SCROLL COMPRESSOR

RELATED APPLICATIONS

This application is a continuation of PCT Application No. PCT/IB2008/001318, which was filed on Jan. 30, 2008.

BACKGROUND OF THE INVENTION

This application relates to a temporary coating for a sealed compressor, to provide lubricant at bearing surfaces for start-up.

Refrigerant compressors are typically mounted in a sealed container. An electric motor is provided in the sealed container and drives a rotating shaft. The rotating shaft drives a pump unit to compress the refrigerant.

One known type of compressor pump unit is a scroll compressor. In a scroll compressor, the rotating shaft has an eccentric pin that works in combination with a rotation prevention mechanism, typically an Oldham coupling, to cause orbiting movement of an orbiting scroll member. The orbiting scroll member has a base with a generally spiral wrap extending from the base. The wrap interfits with a wrap from a non-orbiting scroll member, and compression chambers are defined between the two wraps. As the orbiting scroll member orbits, the size of the compression chambers decreases and an entrapped refrigerant is compressed.

In scroll compressors, and in other types of compressors, a liquid lubricant is typically pulled upwardly through passages in the shaft to lubricate sliding surfaces in the compressor pump unit. The lubricant serves to lubricate the surfaces, and prevent wear or other damage to the components sliding or rotating relative to each other.

However, at start-up, it may be the case that sufficient liquid lubricant will not be at those surfaces. Thus, there may sometimes be damage to the surfaces before the lubricant can reach the sliding surfaces. This is especially true at initial run-in of the compressor, when it is initially started.

In particular, at initial run-in of the compressor, a problem called "edge loading" can occur, since there is typically some small misalignment between the rotating shaft and several bearings that mount the shaft. This misalignment can result in edges of the bearing contacting the shaft over a limited surface, rather than providing support over a larger surface area. Seizure and undue wear of portions of the components can occur, which is undesirable. This problem is made more acute if there is insufficient lubricant during the initial run-in.

Also, modern refrigerants, which may include mixtures of R32 and R125, or a mixture of R143a and R125 can have some undesirable interaction in compressors utilizing ester oil or ether oil as a lubricant. In such compressors, the refrigerant which circulates over the bearing surfaces, can pull the lubricant away from the bearing surfaces back downwardly into the sump. When this occurs, there is even less lubricant during the initial start-up.

It is known in the prior art to provide various types of bearings having self-lubricating properties. As an example, any number of prior art patents have proposed utilizing bearings having impregnated polytetrafluoroethylene ("PTFE") material. In general, these proposals could be characterized as somewhat complex and expensive.

In addition, these bearings do not address the lack of liquid lubricant at the sliding surfaces at initial start-up of the compressor.

SUMMARY OF THE INVENTION

In a disclosed embodiment of this invention, a self-lubricating material is sprayed onto components that will be part of the relatively sliding surfaces. The spray only provides lubricant for a short period of time after initial start-up of the compressor, however, it is this run-in period which is most problematic. In a disclosed embodiment, the self-lubricating material is a dry material. In one proposed embodiment, it is a PTFE spray material.

These and other features of the present invention can be best understood from the following specification and drawings, the following of which is a brief description.

DETAILED DESCRIPTION OF THE PREFERRED EMBODIMENT

Figure 1:
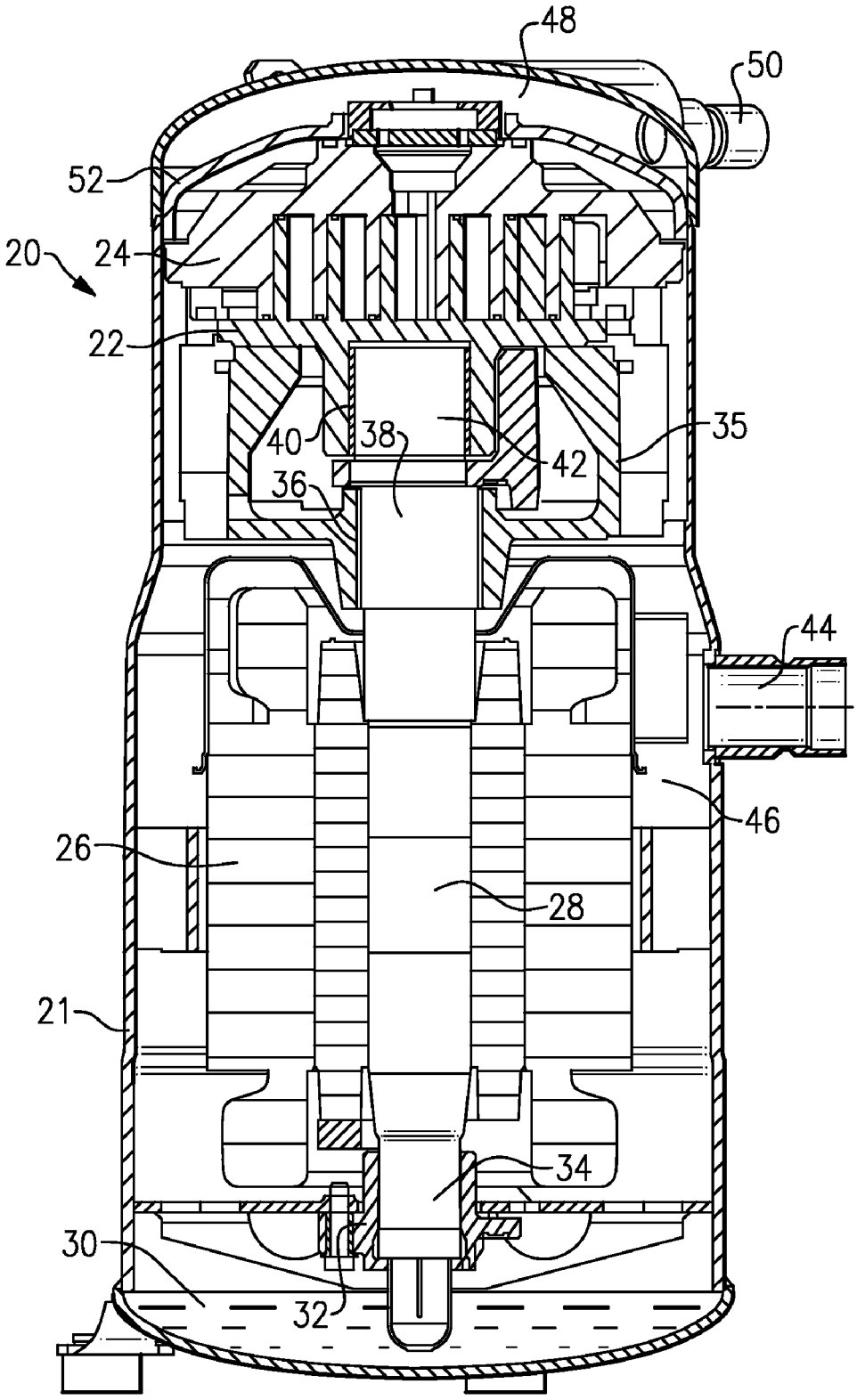
FIG. 1 is a cross-sectional view through a scroll compressor incorporating the present invention.

A compressor 20 is shown in FIG. 1 as a scroll compressor. The scroll compressor has an orbiting scroll member 22, and a non-orbiting scroll member 24. An electric motor 26 drives a rotating shaft 28. The components sit within a sealed shell 21. An oil sump 30 is defined at the bottom of the shell 21. A first bearing 32 mounts a lower end 34 of the shaft 28. Crankcase 35 includes another bearing 36 supporting an intermediate portion 38 of the shaft 28. An upper bearing 40 is formed within the orbiting scroll 22, and supports an eccentric pin 42 from the shaft 28.

As is known, an inlet or suction tube 44 delivers refrigerant into a chamber 46 surrounding the motor 26. That refrigerant circulates to cool the motor, and is delivered to compression chambers between the scroll members 22 and 24. This refrigerant is allowed to circulate over the bearing surfaces. As mentioned above, when particular refrigerants such as mixtures of R32 and R125, or a mixture of R143a and R125 are utilized in a compressor utilizing ester oil or ether oil as its lubricant, the problem mentioned above can occur.

The refrigerant is compressed between the scroll members 22 and 24 and delivered into a discharge chamber 48, and through a discharge tube 50 to a downstream location, such as to a condenser in an air conditioning unit.

As mentioned above, in the prior art, there has sometimes been a lack of lubricant at sliding surfaces, such as the bearings 40, 36, and 32. This often occurs at initial run-in or start-up of the compressor.

Figure 2:
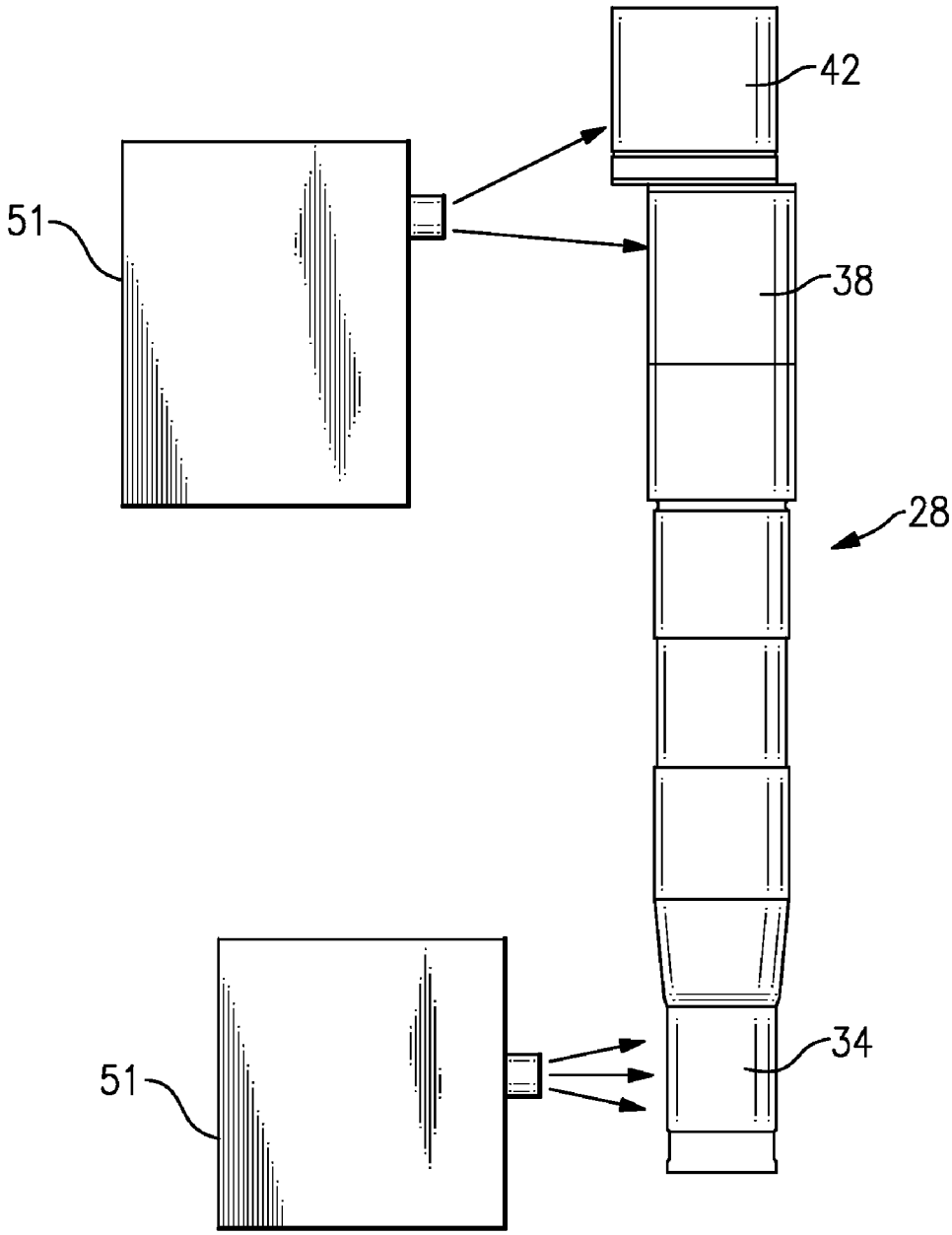
FIG. 2 shows a shaft from the FIG. 1 compressor.

FIG. 2 shows a shaft 28 in which a PTFE spray, shown schematically by box 51, is sprayed onto surfaces 34, 38 and 42. The shaft 28 can now be mounted within the motor, the shell sealed, and the compressor charged with refrigerant. At initial start-up of the compressor, the PTFE coated shaft will provide lubricant.

Figure 3A:
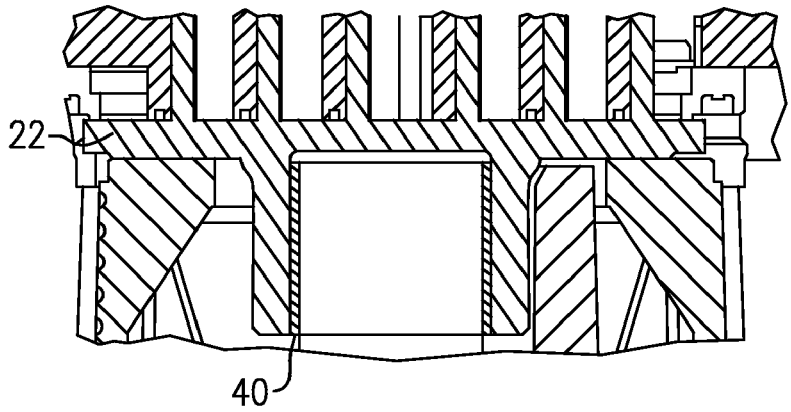
FIG. 3A shows a first bearing surface.
Figure 3B:
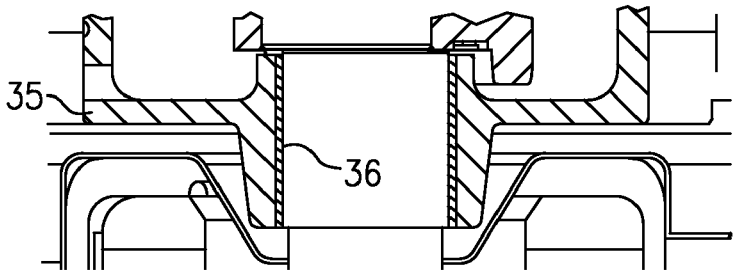
FIG. 3B shows a second bearing surface.
Figure 3C:
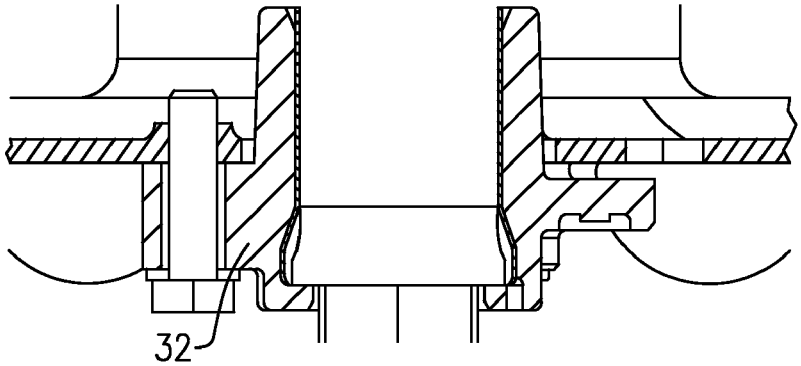
FIG. 3C shows a third bearing surface.

The sprayed locations 34, 38 and 42 corresponding to the locations of the bearings 40, 36, and 32 as shown in FIGS. 3A-3C. On the other hand, the spray material could be sprayed on the bearing locations 40, 36, and 32. However, it may be simpler to spray the self-lubricating material onto the shaft as shown in FIG. 2.

The spray coating can be applied in a very thin layer, and may be less than 50 micrometers, and preferably between 5 and 10 micrometers. Such thicknesses are sufficient to fill up any microscopic grooves on the shaft surface. Any wear during run-in to accommodate misalignment will occur in parallel with the removal of the sprayed layer, but while the sprayed layer will prevent undue wear and seizure of the bearing material.

While any number of self-lubricating material may be utilized, a dry self-lubricating material is preferred. The dry material will not fall back downwardly into the oil sump, even if the compressor is shipped and stored for long periods of time, and will not interact with the above mentioned particular refrigerants. Even more preferably, a polytetrafluoroethylene material, typically known as Teflon® may be utilized. One potential material is available under the trade name Lubrifiant A Sec, from Ront Production. See www.ront.com. However, other materials may be utilized. While spray materials are disclosed, other methods of depositing the layer can be used.

While embodiments of this invention have been disclosed, a worker of ordinary skill in this art would recognize that certain modifications would come within the scope of this invention. For that reason, the following claims should be studied to determine the true scope and content of this invention.

What is claimed is:

1. A compressor comprising:

a sealed container;

an electric motor and a compressor pump unit both mounted within said sealed container;

a shaft driven by said electric motor to drive said compressor pump unit;

a bearing surface formed between said shaft and at least one other component within said sealed container, and a dry lubricant deposited onto at least one of said beating surface and said shaft prior to said sealed container being enclosed to provide lubrication at initial start-up of the compressor, said dry lubricant only providing lubrication for a short period of time after initial start-up of the compressor; and oil being provided in the sealed container, with said oil providing lubrication beginning soon after initial start-up.

2. The compressor as set forth in claim 1, wherein said compressor pump unit is a scroll compressor.

3. The compressor as set forth in claim 1, wherein said bearing surface includes at least one fixed surface.

4. The compressor as set forth in claim 3, wherein said at least one fixed surface includes a bearing at a lower end of said shaft, on a remote end of said electric motor from said compressor pump unit.

5. The compressor as set forth in claim 3, wherein said at least one fixed surface includes a crankcase for supporting a portion of said compressor pump unit.

6. The compressor as set forth in claim 1, wherein said bearing surface is a moving surface between said shaft and a portion of said compressor pump unit.

7. The compressor as set forth in claim 6, wherein said compressor pump unit is a scroll compressor unit, and said bearing surface is a bearing mounted within a rear face of an orbiting scroll forming a portion of said compressor pump unit.

8. The compressor as set forth in claim 1, wherein said dry lubricant is deposited on said shaft.

9. The compressor as set forth in claim 8, wherein said dry lubricant is sprayed onto said shaft.

10. The compressor as set forth in claim 1, wherein said dry lubricant is deposited in a layer less than 50 micrometers.

11. The compressor as set forth in claim 10, wherein said layer is between 5 and 10 micrometers.

12. The compressor as set forth in claim 1, wherein a refrigerant is charged within said compressor, said refrigerant being one of a mixture of R32 and R125, and a mixture of R143a and R125, and said oil being one of an ester oil or ether oil.

13. A compressor comprising:

a sealed container;

an electric motor and a compressor pump unit both mounted within said sealed container;

a shaft driven by said electric motor to drive said compressor pump unit;

a bearing surface formed between said shaft and at least one other component within said sealed container, and a dry lubricant deposited onto at least one of said bearing surface and said shaft prior to said sealed container being enclosed to provide lubrication at initial start-up of the compressor; and said layer is between 5 and 10 micrometers, said dry lubricant only providing lubrication for a short period of time after initial start-up, and oil provided in an oil sump of the compressor to provide lubrication beginning soon after initial start-up.

14. The compressor as set forth in claim 13, wherein said dry lubricant is a polytetrafluoroethylene material.

15. The compressor as set forth in claim 13, wherein a refrigerant is charged within said compressor, said refrigerant being one of a mixture of R32 and R125, and a mixture of R143a and R125, and said oil being one of an ester oil or ether oil.

16. A method of providing lubricant for an initial starting of a compressor comprising:

providing an electric motor and a compressor pump unit to be mounted within a sealed container;

providing a shaft to be driven by said electric motor to drive said compressor pump unit;

depositing a dry lubricant on surfaces between said shaft and at least one support surface; and mounting said shaft into said motor and in said support surface and then closing said sealed container;

spraying said dry lubricant onto said shaft, said dry lubricant only providing lubrication for a short period of time after initial start-up of the compressor; and oil being provided in the sealed container, the oil providing lubrication soon after initial start-up of the compressor.

17. The method as set forth in claim 16, wherein said dry lubricant is placed on said shaft prior to said shaft being mounted in said motor.

18. The method as set forth in claim 16, wherein said dry lubricant is deposited in a layer less than 50 micrometers.

19. The method as set forth in claim 18, wherein said layer is between 5 and 10 micrometers.

20. The method as set forth in claim 16, wherein a refrigerant is charged within the compressor, the refrigerant being one of a mixture of R32 and R125, and a mixture of R143a and R125, and said oil being one of an ester oil or ether oil.

* * * * *

UNITED STATES PATENT AND TRADEMARK OFFICE

CERTIFICATE OF CORRECTION

PATENT NO. : 8,096,796 B2
APPLICATION NO. : 12/060394
DATED : January 17, 2012
INVENTOR(S) : Ginies et al.

It is certified that error appears in the above-identified patent and that said Letters Patent is hereby corrected as shown below:

ON THE TITLE PAGE:

Item [75] Inventor: Meldener's should read as follows: --Gael Meldener, Lyon (FR)--

Signed and Sealed this
Twentieth Day of March, 2012

David J. Kappos
*Director of the United States Patent and Trademark Office*